US009914568B2

(12) United States Patent
Rud

(10) Patent No.: US 9,914,568 B2
(45) Date of Patent: Mar. 13, 2018

(54) TWO DIRECTIONAL SLIDE AND LOCK PACKAGE

(71) Applicant: Sonoco Development, Inc., Hartsville, SC (US)

(72) Inventor: Diana Kay Rud, Sandwich, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/427,255

(22) Filed: Feb. 8, 2017

(65) Prior Publication Data

US 2017/0144807 A1 May 25, 2017

Related U.S. Application Data

(63) Continuation-in-part of application No. 14/636,827, filed on Mar. 3, 2015, now Pat. No. 9,573,746.

(51) Int. Cl.

| | |
|---|---|
| ***B65D 45/00*** | (2006.01) |
| ***B65D 43/22*** | (2006.01) |
| ***E05D 15/06*** | (2006.01) |
| ***E05B 65/00*** | (2006.01) |
| ***B65D 43/20*** | (2006.01) |
| ***B65D 25/22*** | (2006.01) |
| ***B65D 75/36*** | (2006.01) |

(52) U.S. Cl.

CPC ..... *B65D 43/22* (2013.01); *B65D 25/22* (2013.01); *B65D 43/20* (2013.01); *B65D 75/366* (2013.01); *E05B 65/00* (2013.01); *E05D 15/0621* (2013.01)

(58) Field of Classification Search

CPC ..... B65D 43/22; B65D 75/366; B65D 43/20; B65D 25/22; B65D 65/38; B65D 2075/362; B65D 2575/363; B65D 2575/368; B65D 2075/361; E05B 65/00; E05D 15/0621

USPC ..... 206/468, 232, 461, 462, 463, 464, 465, 206/467, 471, 469, 470, 751, 758, 223, 206/485, 485.1, 486, 487, 562, 557, 564, 206/565, 560; 220/315, 252, 811, 812, 220/813

See application file for complete search history.

(56) References Cited

U.S. PATENT DOCUMENTS

| | | | | |
|---|---|---|---|---|
| 3,467,248 | A | 9/1969 | Makowicki | |
| 4,133,429 | A | 1/1979 | Kuchenbecker | |
| 5,129,538 | A * | 7/1992 | Bennett | B65D 43/20 220/315 |
| 5,944,177 | A | 8/1999 | Nemoto | |
| 6,523,689 | B2 | 2/2003 | Mickel | |
| 8,328,016 | B2 | 12/2012 | Thornton et al. | |
| 8,701,889 | B2 | 4/2014 | Loftin | |

(Continued)

*Primary Examiner* — Kareen Thomas

(74) *Attorney, Agent, or Firm* — Miller, Matthias & Hull LLP

(57) ABSTRACT

A two piece thermoformed container comprising a tray and a lid for holding large and small objects is provided. The container is portable, recloseable and provides easy access to the contents. The tray includes a front wall, rear wall and opposing side walls. Each side wall defines an elongated rib. The lid comprises front and rear covering portions, a recessed covering portion and side walls. The lid side walls form grooves which receive the tray ribs. The lid is moveable in a sliding fashion in two directions between a fully closed position in which the lid is substantially aligned with the tray and an opened position in which lid is positioned partly forward or rearward with respect to the tray.

9 Claims, 11 Drawing Sheets

(CLOSED)

(OPEN)

(56) References Cited

U.S. PATENT DOCUMENTS

| | | | | |
|---|---|---|---|---|
| 8,813,959 | B2 | 8/2014 | Hansen et al. | |
| 2002/0108878 | A1* | 8/2002 | Mickel | B65D 75/366 206/468 |
| 2006/0049073 | A1* | 3/2006 | Shannon | B65D 77/2016 206/459.5 |
| 2007/0051726 | A1* | 3/2007 | Arkins | B65D 43/20 220/345.1 |
| 2010/0307116 | A1* | 12/2010 | Fisher | B65D 51/28 53/492 |
| 2012/0037534 | A1* | 2/2012 | Omage | B65D 43/12 206/557 |

* cited by examiner (CLOSED)

(OPEN)

(TRAY)

(LID)

(FRONT)

(MIDDLE)

(REAR)

TWO DIRECTIONAL SLIDE AND LOCK PACKAGE

CROSS REFERENCE TO RELATED APPLICATION

This application is a continuation-in-part of U.S. application Ser. No. 14/636,827, filed Mar. 3, 2015. U.S. application Ser. No. 14/636,827 is incorporated here by reference in its entirety to provide continuity of disclosure.

BACKGROUND OF THE INVENTION

Field of the Invention

This disclosure relates to a package having a sliding lid. More particularly, this disclosure relates to a two piece thermoformed container that is portable, recloseable and provides easy access to the contents.

Description of the Related Art

Packages including sliding components for opening and closing the package are known. For example, Makowicki U.S. Pat. No. 3,467,248 discloses a blister package comprising a folded display card 16 defining channels within which a tray 44 can slide. The card 16 includes a locking tab 42 that prevents the tray 44 from being completely removed (col. 3, lines 9-17).

Similarly, Kuchenbecker U.S. Pat. No. 4,133,429 discloses a blister package 10 comprising a paperboard card 14 defining channels within which a blister pack 11 can slide. The card 14 is bendable at 21 (FIG. 2) to allow the blister pack 11 to be removed from the card 14.

Nemoto U.S. Pat. No. 5,944,177 discloses a package comprising a plastic tray 2 and a sliding paperboard mount 3. The mount 3 slides within channels formed along the sides of the tray 2. Cuts 9 located in the mount 3 form engaging pieces 10 which engage the channels in the tray 2 (FIG. 10).

Mickel U.S. Pat. No. 6,523,689 discloses another package comprising a plastic tray 22 and a sliding backing card 24. Side wall 34 (FIGS. 2 and 6) extends upward from the flange 28, and defines a groove extending at least one third the length of the side wall.

Thornton U.S. Pat. No. 8,328,016 discloses yet another blister pack and sliding backboard combination. A locking tab 30 on the backboard fits into a slot 38 in the blister pack 14 (FIG. 1) to lock the two components together.

Loftin U.S. Pat. No. 8,701,889 discloses a pill container comprising a base 11, a shell 40 attached to the base 11 that forms a sheath around an insert 20, and a lid 12 hingedly attached to the base 11. When the lid 12 is opened the insert 20 can be slid outward for access to the pills. In one embodiment shown in FIG. 2A the shell has an indexing tab 47 which extends into a cutout area to allow the insert 20 to be withdrawn to a plurality of discrete positions.

U.S. Pat. No. 8,813,959 discloses a container having a lid 40 that slides within a channel 18 formed between a plastic tray flange 14 and a third component, a paperboard panel 30 (FIG. 5A).

There remains a need for a container that can hold large and small objects, is portable, recloseable and provides easy access to the contents. The present disclosure addresses those needs.

BRIEF SUMMARY OF THE INVENTION

The present disclosure relates to a two piece thermoformed container that can hold large and small objects. The container comprises a tray and a lid and is portable, recloseable and provides easy access to the contents.

In one aspect the container tray comprises a bottom wall having a periphery. Side walls, a front wall and a rear wall extend upward from the periphery and terminate in a rim that defines an opening. The tray further comprises a flange extending outwardly from the rim. More particularly, each tray side wall may comprise a lower section extending upward from the bottom wall to an inner edge, a substantially horizontal ledge extending outward from the inner edge and terminating in an outer edge, and an upper section extending upward from the outer edge and terminating at the rim. The upper section includes an elongated rib extending inwardly from each side wall above and substantially parallel to the ledge. The tray may have dimple stops extending upward from the ledge near each side wall and near the front wall. The lid comprises a cover portion that covers the opening and a flange that extends outward from the periphery of the cover portion. The cover portion comprises a rear cover portion and a front cover portion. The rear cover portion may be substantially flat and defines a plane. The front cover portion may be tray shaped and comprises a recessed back wall extending downward from a front edge of the rear cover portion, and a recessed front wall and recessed side walls extending downward from the top wall periphery. A recessed cover portion extends between the recessed front wall, recessed back wall and recessed side walls. The recessed cover portion may include one or more dimples configured to receive and mate with the dimple stops on the tray to lock the lid in the closed position before and after each use. Each recessed side wall defines a groove configured to receive one of the elongated ribs in the tray side walls to secure the lid to the tray in sliding fashion. The lid may comprise backstops integrally formed in the recessed back wall. The lid is moveable in a sliding fashion between a fully closed position in which the recessed front wall of the lid abuts the tray front wall, and a fully opened position in which the one or more backstops abut the tray rear wall.

In another aspect the container tray comprises a bottom wall, side walls, a front wall, a rear wall and an upper structure. The bottom wall has a periphery. The side walls, front wall and rear wall extend upward from the periphery and terminate in an inner edge that defines an opening. The upper structure comprises a ledge extending outward from the inner edge and terminates in an outer edge, an inner wall extending upward from the outer edge and terminating at a rim, and a flange extending outwardly from the rim. The upper structure further comprises two axially elongated ribs extending inwardly from the inner wall above each side wall. The lid comprises a cover portion that covers the tray opening, two lid sidewalls extending upwardly from the cover portion and terminating in a rim, and two flanges extending laterally outward from the rim. The lid cover portion comprises a rear cover portion, a substantially coplanar front cover portion and a recessed cover portion that is recessed below the front cover portion and the rear cover portion. Each lid side wall defines a groove configured to receive an elongated rib to secure the lid to the tray. The lid is moveable in a sliding fashion in a forward direction between a fully closed position in which the cover portion completely covers the opening and an open position in which the cover portion does not completely cover the opening. The lid is also movable in a sliding fashion in an opposite direction between the fully closed position in which the cover portion completely covers the opening and a second open position in which the cover portion does not completely cover the opening.

DETAILED DESCRIPTION OF THE INVENTION

Figure 1:
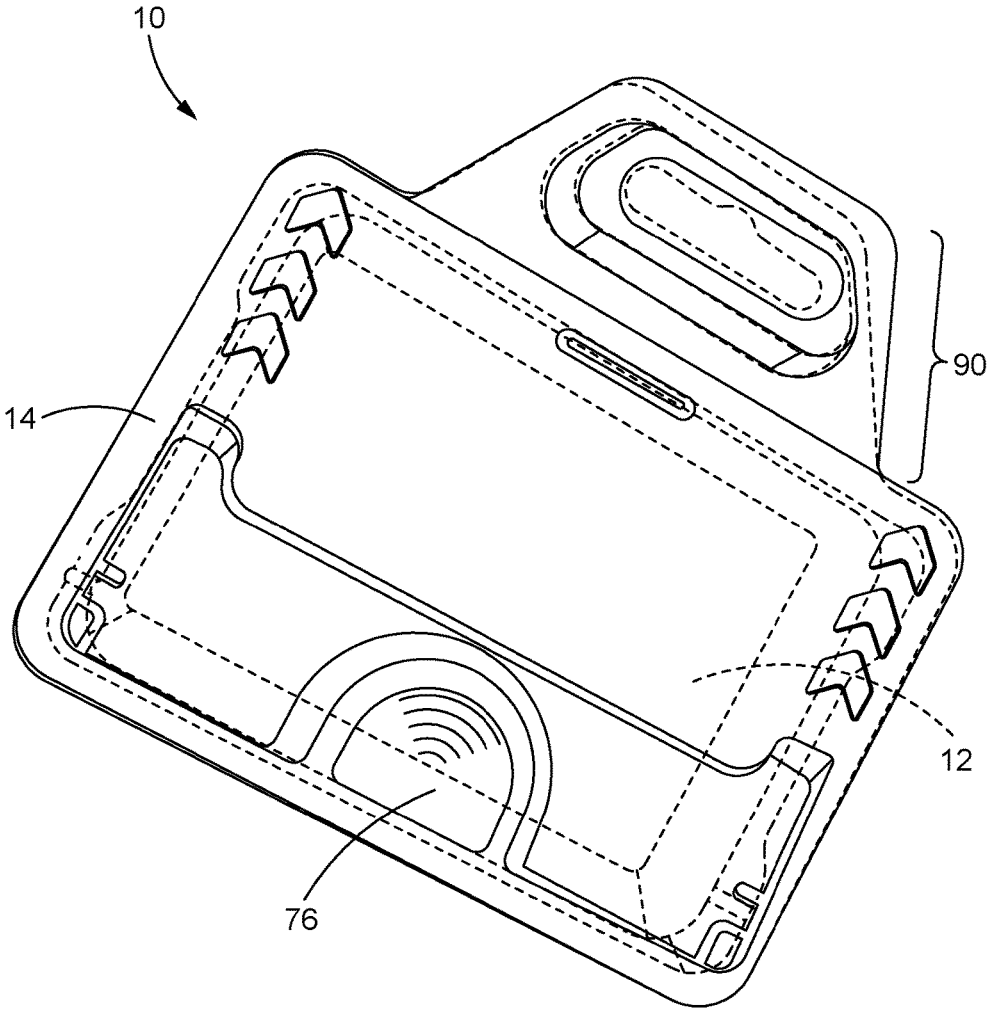
FIG. 1 is a perspective view of a package according to the disclosure shown in the closed position, comprising a tray and lid.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments. When first and second opposing mating structures are described as being part of the tray and lid respectively, such as dimples and dimple stops or ribs and grooves, it should be understood that the structures may be reversed, so that the structure formed in the tray may instead be formed in the lid, and vice versa.

Turning to the drawings, there is shown in FIG. 1 one embodiment of the present invention, a two piece thermoformed container 10 that can hold large and small objects. The container 10 is portable, recloseable and provides easy access to the contents.

Figure 2:
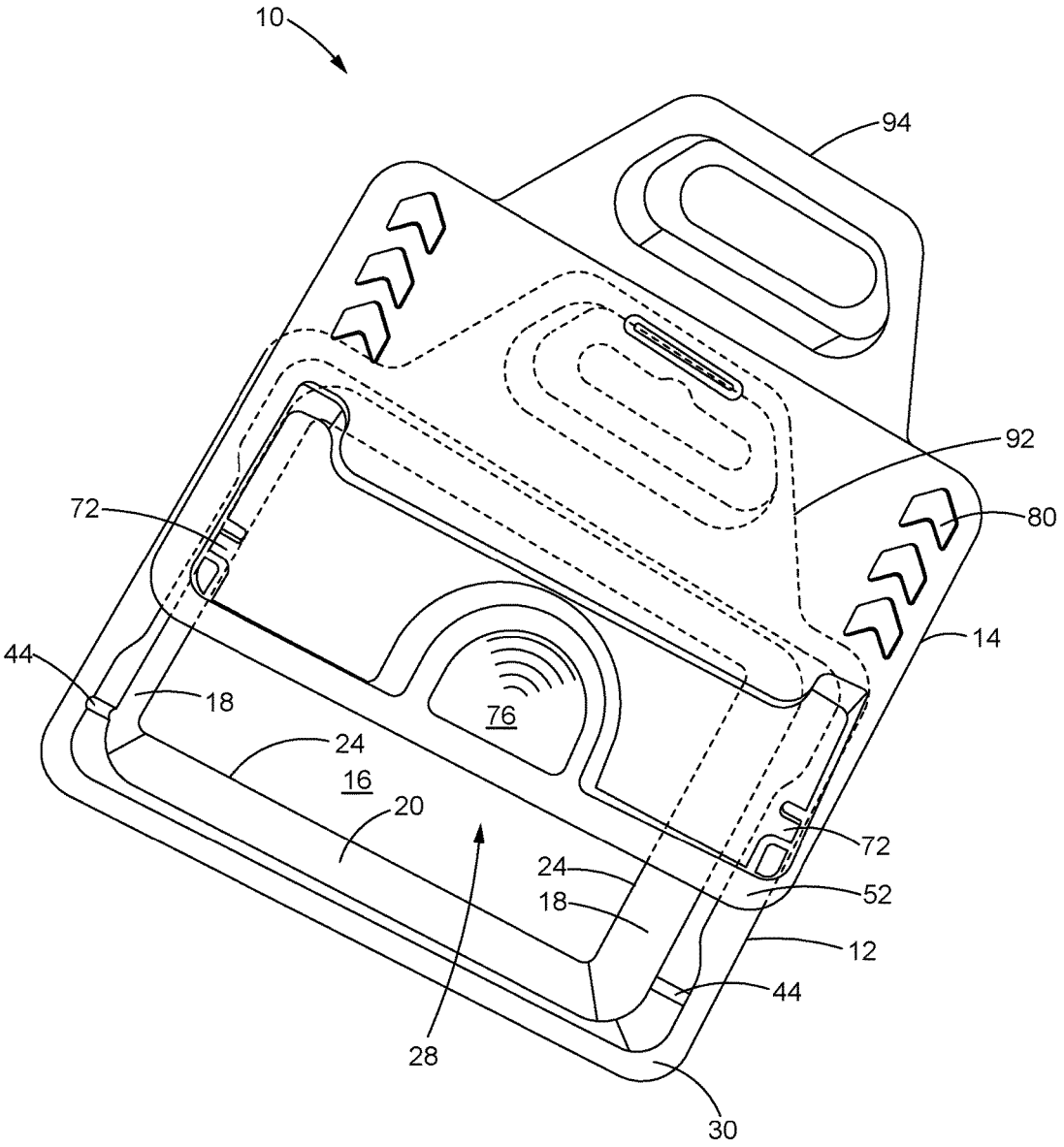
FIG. 2 is a perspective view of the package of FIG. 1 shown in the open position.

FIG. 1 is a perspective view of the container 10 in the closed position and FIG. 2 is a perspective view of the container 10 in the open position. The container 10 comprises a tray 12 and a sliding lid 14.

Figure 3:
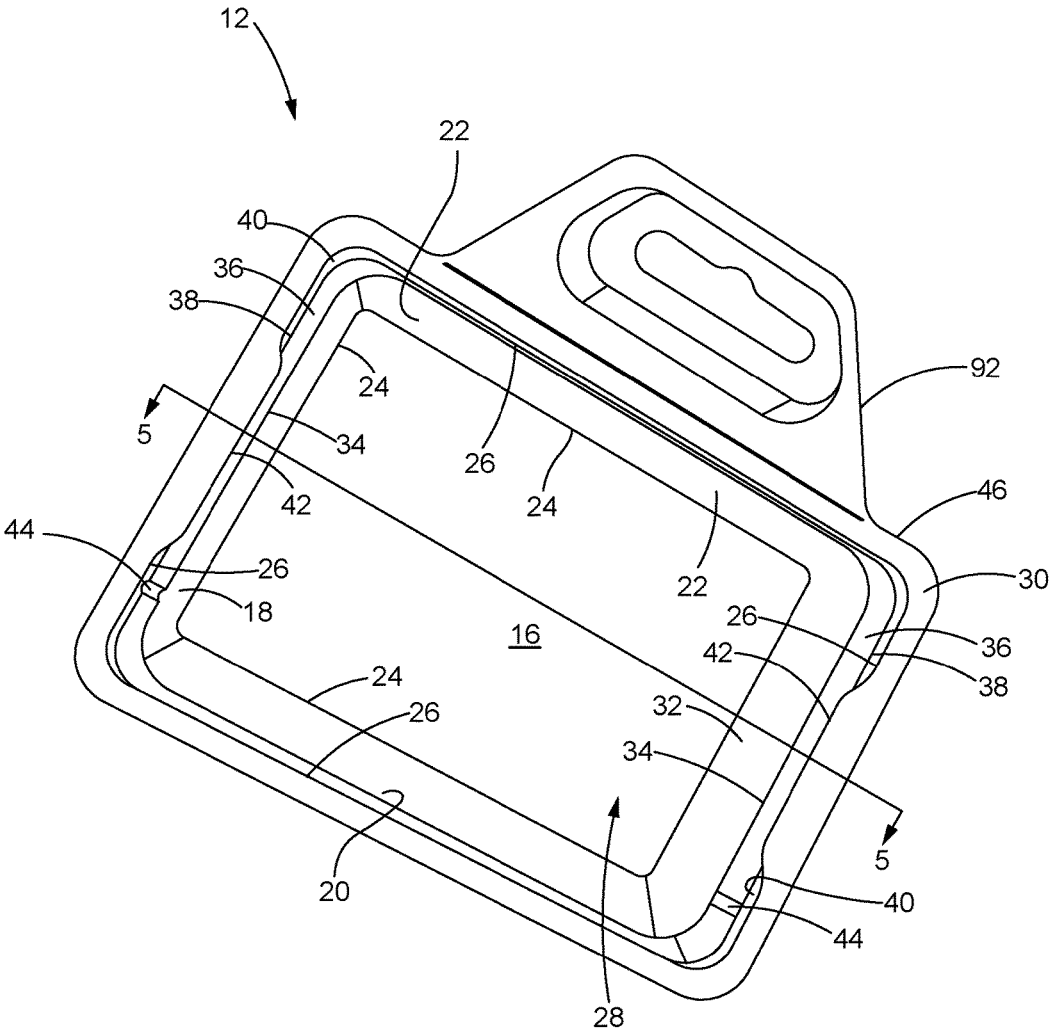
FIG. 3 is a perspective view of the tray of FIG. 1.

The tray 12, best shown in FIG. 3, comprises a bottom wall 16, side walls 18, a front wall 20 and a rear wall 22. The side walls 18, front wall 20 and rear wall 22 extend upward from the periphery 24 of the bottom wall 16 and terminate in a rim 26 that defines an opening 28. A flange 30 may extend outwardly from the rim 26.

Figure 5:
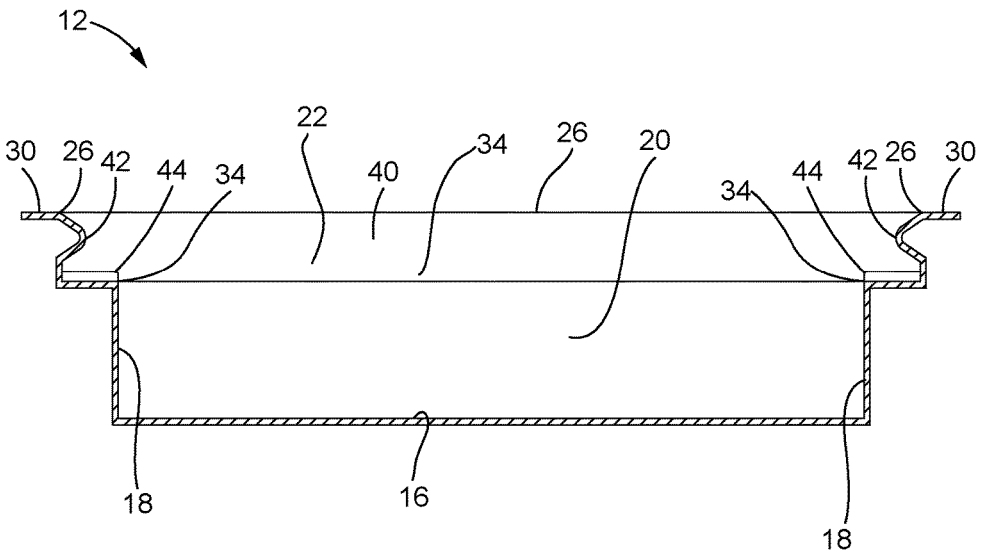
FIG. 5 is a cross-sectional view taken along line 5-5 of FIG. 3.

More particularly, each side wall 18 may comprise a lower section 32 extending upward from the bottom wall periphery 24 to an inner edge 34, a ledge 36 extending outward from the inner edge 34 and terminating in an outer edge 38, and an upper section 40 extending upward from the outer edge 38 and terminating at the rim 26. As perhaps best shown in FIG. 5, the upper section 40 of each side wall 18 includes an inwardly extending elongated rib 42 running front to back. The elongated rib 42 extends inwardly from each side wall 18 above and substantially parallel to the ledge 36. A dimple stop 44 extends upward from each ledge 36 near the container front wall 20. The flange may have a rear edge 46.

Figure 4:
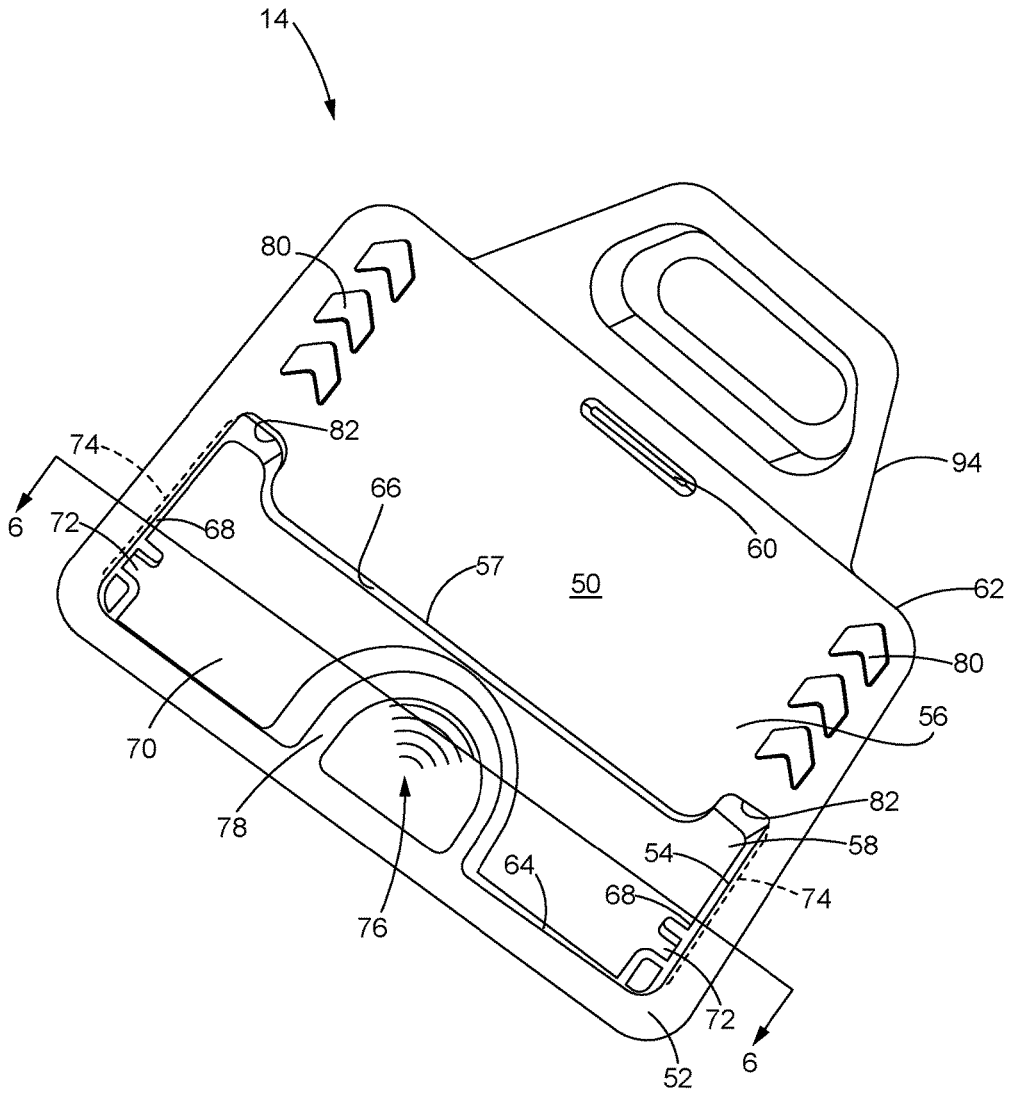
FIG. 4 is a perspective view of the lid of FIG. 1.

The lid 14, best shown in FIG. 4, comprises a cover portion 50 that covers the opening 28 and a flange 52 that extends outward from the periphery 54 of the cover portion 50 and includes a lid rear edge 62. The cover portion 50 may comprise a substantially planar rear cover portion 56 defining a plane and a front cover portion 58 that is recessed below the plane of the rear cover portion 56. The rear cover portion 56 may include a front edge 57 and a downward extending ridge 60 located near and parallel to the lid rear edge 62. The ridge 60 abuts the rear wall 22 of the tray 12 when the container 10 is closed.

The front cover portion 58 comprises a recessed front wall 64, a recessed back wall 66 extending downward from the front edge 57 of the rear cover portion 56, recessed side walls 68 and a recessed cover portion 70 extending between the recessed front wall 64, recessed back wall 66 and recessed side walls 68. The recessed front wall 64 and recessed side walls 68 may extend downward from the top wall periphery 54. The recessed cover portion 70 may include dimples 72 near the recessed side walls 68 and configured to receive and mate with the dimple stops 44 to help lock the lid 14 in the closed position before and after each use.

Figure 6:
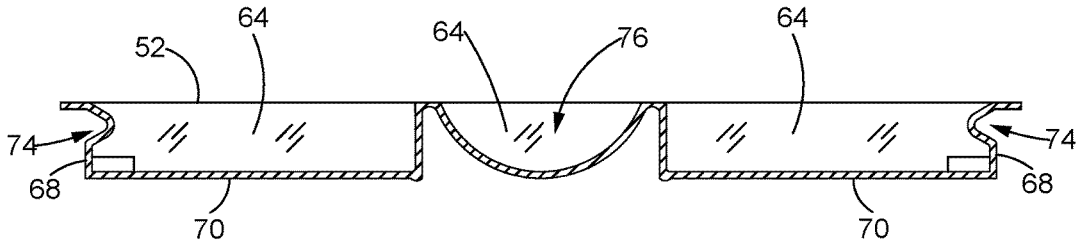
FIG. 6 is a cross-sectional view taken along line 6-6 of FIG. 4.

As perhaps best shown in FIG. 6, each recessed side wall 68 defines a groove 74. The grooves 74 receive the elongated ribs 42 in the tray 12 to secure the lid 14 to the tray 12 in sliding fashion. An optional thumb depression 76 located in the front portion 58 of the lid 14 may be used to open the container 10 as explained below. The thumb depression 76 may be defined by a raised curved ridge 78 extending upward from the recessed cover portion 70 but not above the plane of the rear cover portion 56. Indicia 80 such as arrows may be embossed or otherwise formed on the lid 14 to add structure and thus stability to the lid 14 and to indicate the direction of movement of the lid 14 during opening and/or closing.

One or more optional backstops 82 may extend rearward from the recessed back wall 66. These backstops 82 abut the tray rear wall 22 when the lid is on the fully open position, thus limiting the rearward movement of the lid 14 with respect to the tray 12 and preventing the lid 14 from being fully separated from the tray 12. The backstops 82 may be integrally formed with the recessed back wall 66 and form part of the back wall 66.

An optional two piece hang tab 90 may be included with the container 10 and may comprise a tray tab 92 extending rearward from the tray flange 30 and a lid tab 94 extending rearward from the rear edge 62 of the lid 14. The tray tab 92 and lid tab 94 have complementary shapes so they fit together in close abutting engagement. They may be spot sealed together before the first use. The tray tab 92 and the lid tab 94 may be attached to the tray 12 and lid 14 respectively along hinge lines to allow the tabs 92, 94 to flex with respect to the rest of the container 10. The hinge lines may be perforated or otherwise weakened to allow the hang tab 90 to break off before use.

To open the container 10, a user pushes the lid 14 rearward with respect to the tray 12, typically by placing her thumb in the depression 76 and exerting a rearward force on the lid 14 while holding the tray 12 with her fingers. As she does this, the spot seals, if any, on the hang tab 90 break, the rear portion of the lid 14 flexes slightly upward to allow the ridge 60 in the lid 14 to ride over the tray rear wall 22 (temporarily distorting the lid 14 in the process), and the dimples 72 in the lid 14 release from the dimple stops 44 in the tray 12, the latter two actions being enabled by the flexibility of the tray 12 and lid 14. All the while the tray ribs 42 remain engaged within the lid grooves 74. The lid 14 may be slid rearward until the lid back wall 66 or backstops 82 abut the rear wall 22 of the tray 12 as shown in FIG. 2. As the lid 14 moves with respect to the tray 12, the lid flange 52 slides across and remains in contact with the top of the tray flange 30.

To reclose the container 10 the user again places a thumb or finger in the depression 76 and slides the lid 14 forward until the ridge 60 in the lid 14 rides forward over the tray rear wall 22 and the dimple stops 44 re-engage the dimples 72. When used properly, the lid 14 remains engaged to the tray 12 at all times. In other words, when the lid is in the fully opened position with the lid back wall 66 or backstops 82 abutting the tray back wall 22, the tray ribs 42 still at least partially engage the grooves 74 on either side of the lid 14.

To achieve this "permanent" tray-lid engagement, the distance between the forward end of each groove 74 (the end nearest the recessed front wall 64) and the recessed back wall 66 or backstops 82 must exceed the distance between the rear end of each rib 42 (the end nearest the tray rear wall 22) and the tray rear wall 22. However, due to the flexibility of the tray 12 and lid 14, the two components may be disengaged (separated) if desired.

Alternative Embodiment

In the alternative embodiment shown in FIGS. 7 to 15, a two piece thermoformed container 110 is provided that can hold large and small objects. The container 110 is portable, reclosable, and provides easy access to the contents.

The Container 110

Figure 7:
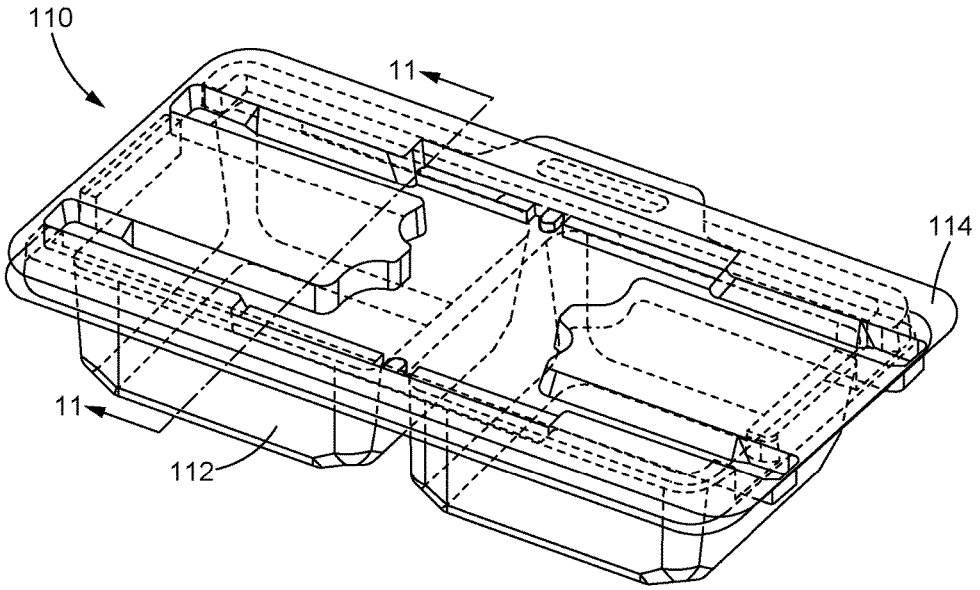
FIG. 7 is a perspective view of an alternative package shown in the closed position, the alternative package comprising a tray and lid.
Figure 8:
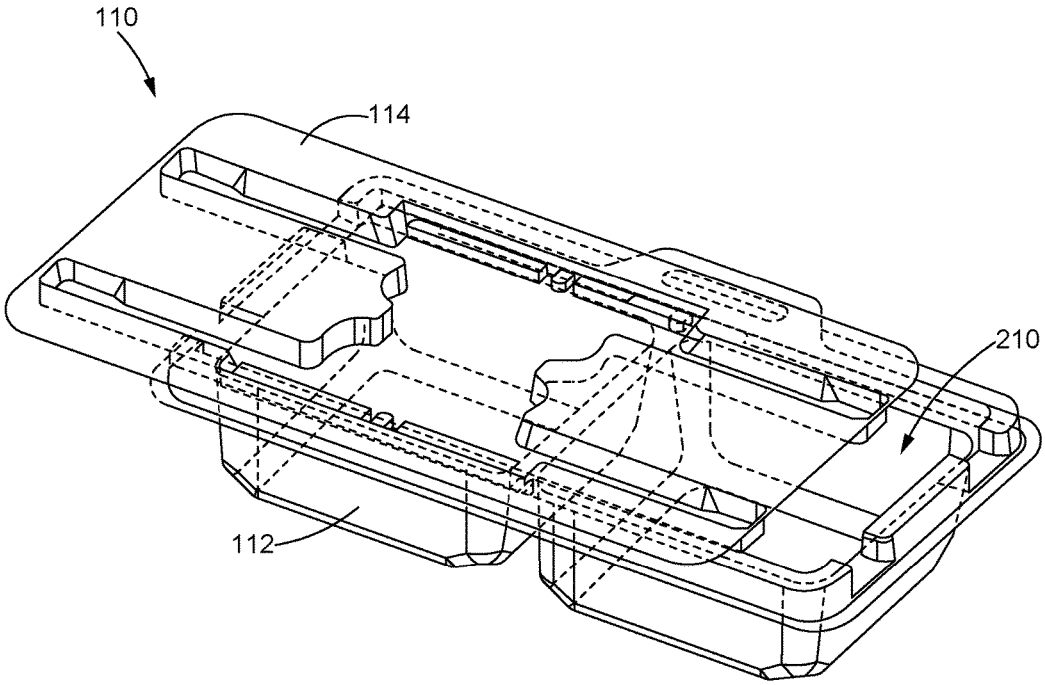
FIG. 8 is a perspective view of the package of FIG. 7 shown in the open position.

FIG. 7 is a perspective view of the container 110 in the closed position and FIG. 8 is a perspective view of the container 110 in the open position. The container 110 comprises a tray 112 and a lid 114. The lid 114 may be moved relative to the tray 112 to expose one of two separate compartments, either a forward compartment 210 or a rear compartment 212. The direction in which the lid 114 may be moved may be referred to as the axial direction, and the direction orthogonal to the axial direction may be referred to as the transverse direction. Thus, the forward compartment 210 and the rear compartment 212 are aligned in the axial direction and are separated by a partition 200 as explained further below.

The Tray 112

Figure 9:
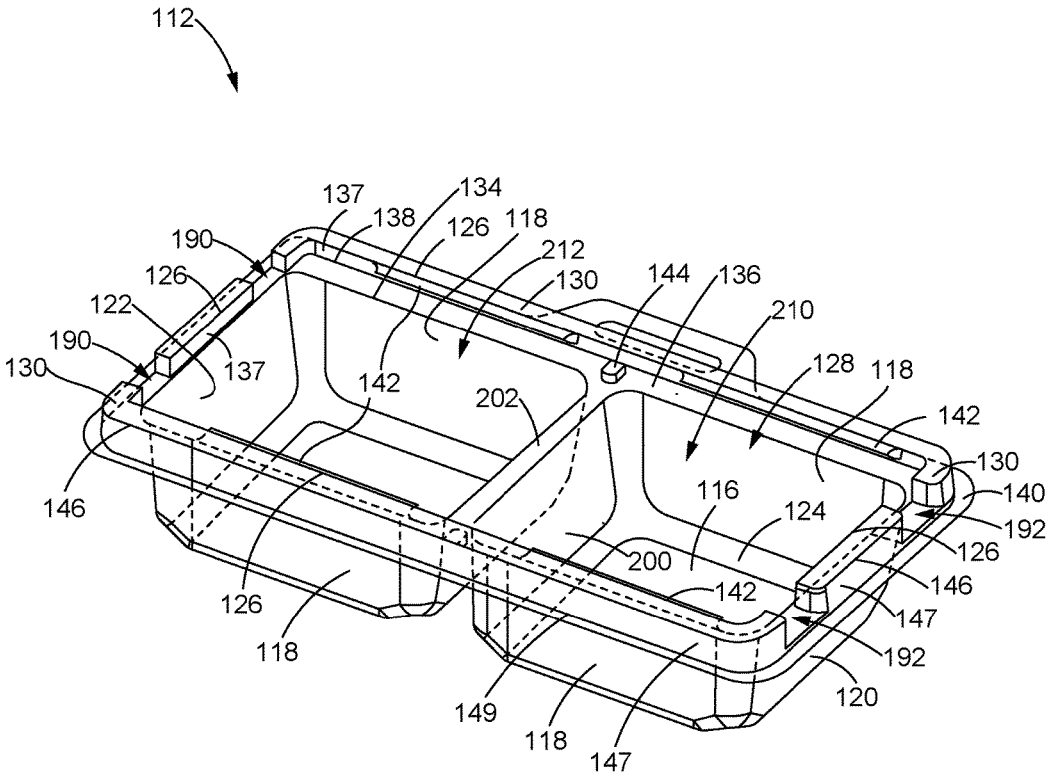
FIG. 9 is a perspective view of the tray of FIG. 7.

FIG. 9 is a perspective view of the tray 112 of FIG. 7. The tray 112 comprises a bottom wall 116, side walls 118, a front wall 120, a rear wall 122 and an upper structure 140. The side walls 118, front wall 120 and rear wall 122 extend upward from a periphery 124 of the bottom wall 116 and terminate at an inner edge 134 that defines an opening 128. The upper structure 140 extends above and is connected to the side walls 118, front wall 120 and a rear wall 122 along the inner edge 134.

Figure 12:
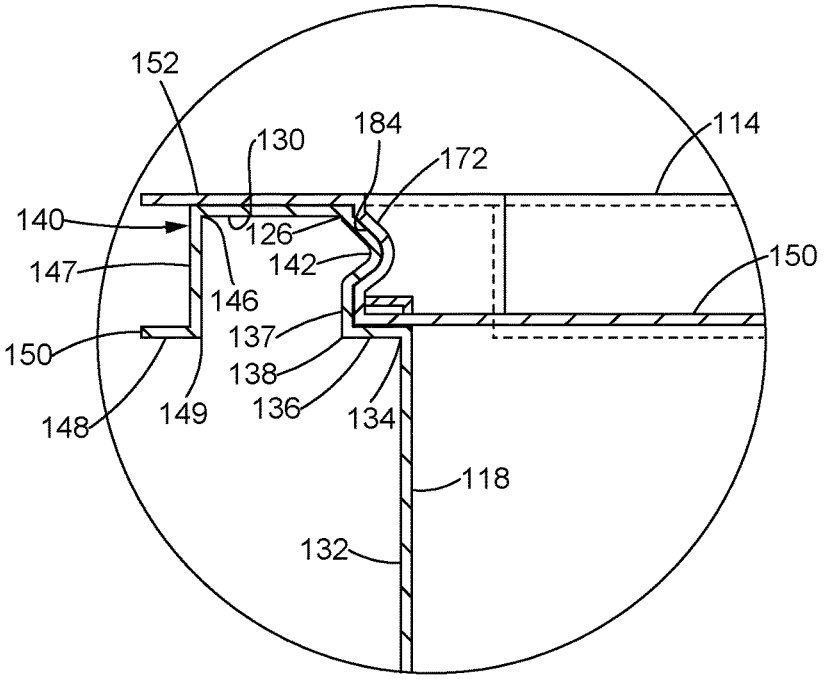
FIG. 12 is an enlarged view of a portion of the package shown in FIG. 11.

As perhaps best shown in FIG. 12, the upper structure 140 may comprise a ledge 136 extending outward from the inner edge 134 and terminating in an outer edge 138, an inner wall 137 extending upward from the outer edge 138 and terminating at a rim 126, a flange 130 extending outwardly from the rim 126 and terminating at a distal edge 146, an outer skirt 147 extending downwardly from the distal edge 146 and terminating at a lower edge 149, and a lower flange 148 extending outwardly from the lower edge 149.

The inner wall 137 may include one or more and preferably two inwardly extending axially elongated ribs 142 along each side wall 118. Each elongated rib 142 extends inwardly from the inner wall 137 above a tray side wall 118 and may be substantially parallel to the ledge 136. Each rib 142 is configured to cooperate with a corresponding groove 184 in the lid 114 to secure the lid 114 to the tray 112 while the lid 114 is moved axially relative to the tray 112 as explained in more detail below.

Dimple Stops 144

A dimple stop 144 may extend upwardly from each ledge 136 midway between the front wall 120 and the rear wall 122. The dimple stops 144 function lock the lid 114 in a closed position as explained below.

Partition 200

Referring to FIG. 9, the tray 112 may comprise a partition 200 that divides the tray 112 into a forward compartment 210 and a rear compartment 212. The partition 200 may extend laterally between the two side walls 118 and upwardly from the tray bottom wall 116 and terminate at a partition top edge 202. The partition top edge 202 may be co-planar and contiguous with each ledge 136 or it may be lower or higher than the ledge 136. Moving the lid 114 in the forward direction exposes (opens) the rear compartment 212 and moving the lid 114 in a rearward direction exposes the forward compartment 210.

Tray Guide Openings 190, 192

The tray upper structure 140 may be discontinuous. More specifically, the tray upper structure 140 may define a pair of laterally spaced apart front guide openings 192 located above the front wall 120 for accommodating front guides 198 and a pair of laterally spaced apart rear guide openings 190 located above the rear wall 122 for accommodating rear guides 199 as explained below.

The Lid 114

Figure 10:
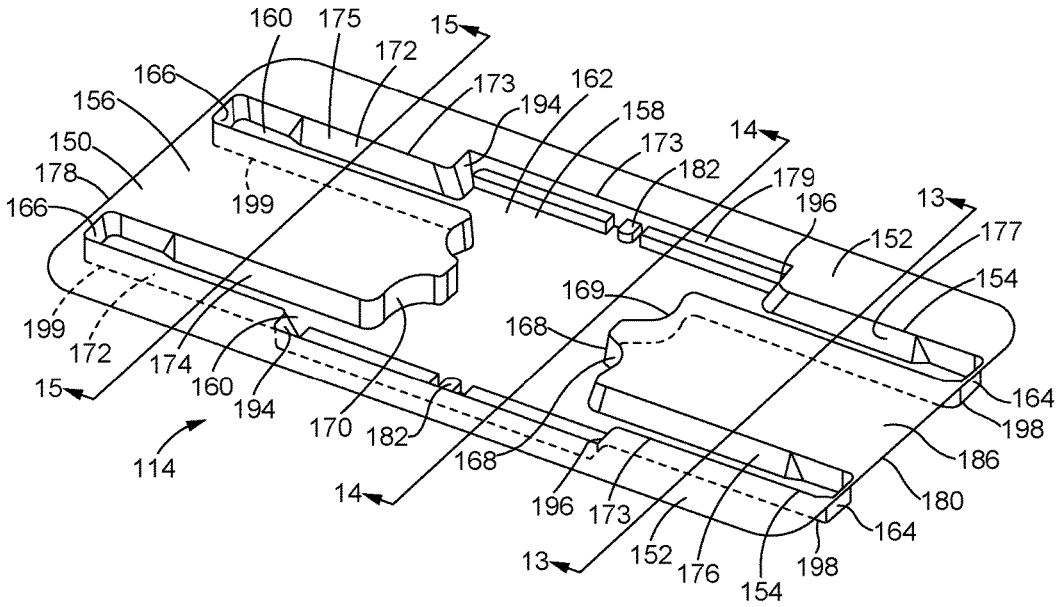
FIG. 10 is a perspective view of the lid of FIG. 7.
Figure 11:
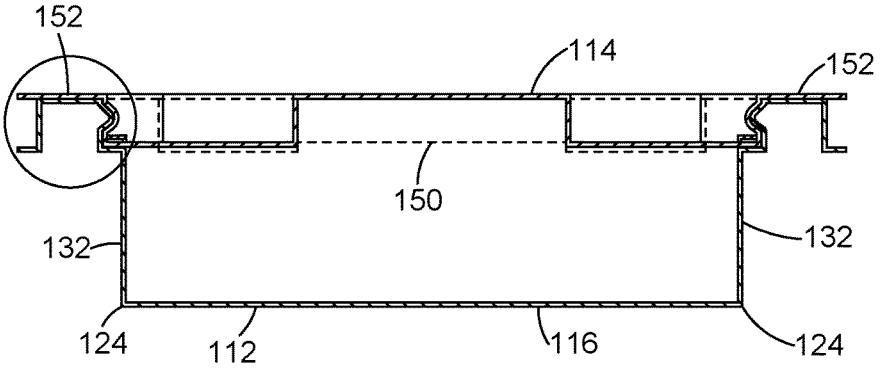
FIG. 11 is a cross-sectional view of the package of FIG. 7 taken along line 11-11.

The lid 114, best shown in FIG. 10, comprises a cover portion 150 that covers the tray opening 128, two side walls 172 extending upwardly from the cover portion 150 and terminating in a rim 173, two side flanges 152 that extend laterally outward from the rim 173, a lid front wall 164 and a lid rear wall 166.

The cover portion 150 may comprise a rear cover portion 156, a substantially co-planar front cover portion 186 and a recessed cover portion 158 that is recessed below the plane of the front cover portion 186 and the rear cover portion 156.

The recessed cover portion 158 may be substantially "H" shaped, having two elongated portions 160 connected to each other by a cross portion 162. Each elongated portion 160 may extend front to back from a lid front wall 164 to a lid rear wall 166. The cross portion 162 may extend from to back from an intermediate front wall 168 to an intermediate rear wall 170 and laterally from one lid side wall 172 to an opposite lid side wall 172. In the closed container 100 the cross portion 162 may rest on the top edge 202 of the partition 200 to segregate the forward compartment 210 from the rear compartment 212.

The rear cover portion 156 may extend from a lid rear edge 178 inwardly forward to the intermediate rear wall 170 and laterally from a rear cover side wall 174 to an opposite rear cover side wall 174. The intermediate rear wall 170 extends downwardly from the front of the rear cover portion 156 to the recessed cross portion 162. Each rear cover side wall 174 extends downwardly from a side of the rear cover portion 156 to a recessed elongated portion 160. Each rear cover side wall 174 extends substantially parallel to a portion of a lid side wall 172.

The distance between each rear cover side wall 174 and the lid side wall 172 may be constant along much of the length of the rear cover side wall 174 and may be about the width of the rear guide openings 190. However, near the rear wall 166, the distance between the rear cover side wall 174 and the lid side wall 172 may be slightly greater than the width of the rear guide openings 190 in the tray 112, thus causing the lid 114 to form a slight compression fit with the tray 112 when the container 110 is in the closed position.

The front cover portion 186 may extend from a lid front edge 180 rearward to an intermediate front wall 168 and laterally from one front cover side wall 176 to an opposite front cover side wall 176. The intermediate front wall 168 extends downward from the rear of the front cover portion 186 to the recessed cross portion 162. Each front cover side wall 176 extends downwardly from a side of the front cover portion 186 to a recessed elongated portion 160. Each front cover side wall 176 extends substantially parallel to a portion of a lid side wall 172.

The distance between each front cover side wall 176 and the lid side wall 172 may be constant along much of the length of the front cover side wall 176 and may be about the width of the front guide openings 192. However, near the front wall 164, the distance between the front cover side wall 176 and the lid side wall 172 may be slightly greater than the width of the front guide openings 192 in the tray 112, thus causing the lid 114 to form a slight compression fit with the tray 112 when the container 110 is in the closed position.

Each side wall 172 extends upward from the recessed cover portion 158 and, more particularly, from one of the elongated portions 160 of the recessed cover portion 158. Each side wall 172 extends substantially the axial length of the lid 114, from the lid front wall 164 to the lid rear wall 166. Each lid side wall 172 may comprise a middle portion 179 located between a side wall front portion 177 and a substantially co-planar side wall rear portion 175. The middle portion 179 may be laterally offset from the front and rear portions 177, 175, away from the center axis of the lid 114. In the assembled container 110 the middle portion 179 of each lid side wall 172 may contact and slide against an inner wall 137 of the tray upper structure 140.

Grooves 184

Figure 14:
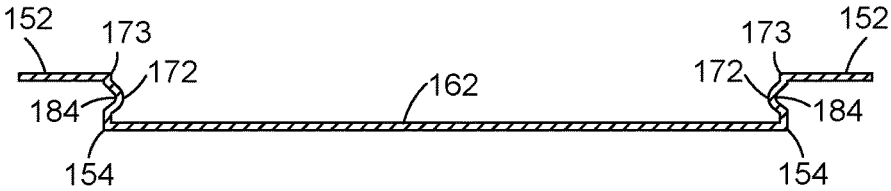
FIG. 14 is a cross-sectional view of the lid of FIG. 10 taken along line 14-14.

As perhaps best shown in FIGS. 12 and 14, each lid side wall 172 defines an outwardly facing groove 184. Each groove 184 is configured to receive a corresponding elongated rib 142 in the tray 112 to secure the lid 114 to the tray 112 in a sliding fashion.

Dimples 182

The lid 114 may include a downwardly facing dimple 182 formed in the recessed cover portion 158 near each side wall 172, preferably midway between the lid front wall 164 and the lid rear wall 166. Each dimple 182 is configured to receive a corresponding dimple stop 144 on the tray 112 to help lock the lid 114 in the closed position before and after each use.

Backstops 194, 196

Each lid side wall 172 may further comprise a rear backstop wall 194 and a front backstop wall 196. The rear backstop wall 194 extends laterally outward from the side wall rear portion 175 to the middle portion 179. The front backstop wall 196 extends laterally outward from the side wall front portion 177 to the middle portion 179. The rear backstop wall 194 and the front backstop wall 196 also function to stop or limit the axial movement of the lid 114 as explained below.

Lid Guides 198, 199

Each front cover side wall 176 and the corresponding side wall front portion 177 form opposing vertical walls of a fingerlike, axially elongated front guide 198. The front guides 198 extend downward from and between the front cover portion 186 and the flange 152. Each front guide 198 terminates at the lid front wall 164. When the lid 114 is slid forward, the two front guides 198 slide within the two corresponding front guide openings 192 in the tray 112.

Likewise, each side wall rear portion 175 and each rear cover side wall 174 form opposing vertical walls of a fingerlike, axially elongated rear guide 199. The rear guides 199 extend downward between the rear cover portion 156 and the flange 152. Each rear guide 199 terminates at the lid rear wall 166. When the lid 114 is slid rearward, the rear guides 199 slide within corresponding guide openings 190 in the tray 112.

Figure 13:
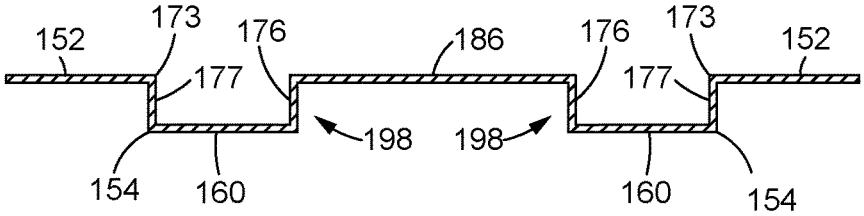
FIG. 13 is a cross-sectional view of the lid of FIG. 10 taken along line 13-13.
Figure 15:
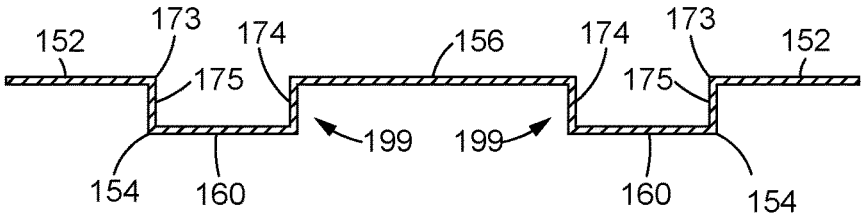
FIG. 15 is a cross-sectional view of the lid of FIG. 10 taken along line 15-15.

FIG. 13 is a cross-sectional view of the lid 114 of FIG. 10 taken along line 13-13, showing the two front guides 198. FIG. 15 is a cross-sectional view of the lid of FIG. 10 taken along line 15-15, showing the two rear guides 199.

Hang Tab 250

An optional hang tab 250 may be included with the container 110 and may extend from either the tray 112 or the lid 114 or both.

Assembling the Container 110

To assemble the container 110, the lid 114 may be secured to the tray 112 by placing the lid 114 onto the tray 112 and bringing the lid 114 and the tray 112 together until the tray ribs 142 engage the lid grooves 184. Also, if the lid 114 and tray 112 are aligned in the closed position, the lid front guides 198 and the lid rear guides 199 will form a compression fit with tray front guide openings 192 and the tray rear guide openings 190. Each dimple stop 144 in the tray 112 fits within a dimple on the lid 114.

Both the lid 114 and the tray 112 are sufficiently resilient to allow the two container components 112, 114 to be repeatedly assembled and disassembled. Also, once the lid 114 is fitted onto the tray 112, the container 110 may be repeatedly opened and reopened.

Opening the Container 110

To access the contents of the container 110 the lid 114 may be slid relative to the tray 112 in either of two opposite directions, that is, either rearwards or frontwards. Indicia such as arrows may be embossed or otherwise formed on the lid 114 to indicate the possible directions of movement of the lid 114 during opening and/or closing. For the purposes of illustration a method of opening the container 110 by sliding the lid 114 forward will now be described, with the understanding that the container 110 also may be opened by sliding the lid 114 in substantially the opposite direction.

To open the container 110, a user simply slides the lid forward 110 relative to the tray 112, typically by applying forward force on the intermediate front wall 168. Finger notches 169 may be formed in the intermediate front wall 168 for that purpose. During opening, the tray dimple stop 144 disengages from the lid dimple 182 and the tray ribs 142 slide within the lid grooves 184. Also, the two lid front guides 198 slide within the front guide openings 192. As the lid 114 moves with respect to the tray 112, the lid flanges 152 slide across and remain in contact with the tray flange 130. The lid side walls 172 and, more particularly, the side wall middle portions 179 of the lid 114, may slide along and remain in contact with the tray side walls 118.

Because the front guides 198 of the lid 114 are slightly wider than the width of the front guide openings 192 in the tray 112 thus forming a compression fit, sliding the lid 114 forward from a closed position (and thus opening the container 110) requires overcoming a slight resistance from the compression fit by slightly distorting the lid 114 and/or the tray 112. This resistance assures that the container 110 remains closed when not in use and does not open inadvertently. Once the container 110 is opened, the lid 14 remains secured to the tray 112 in sliding fashion by the ribs 142 and grooves 184.

The container 110 is designed so that the lid 114 remains attached to the tray 112 even when the container 110 is opened (unless the user removes the lid 114 by force). This is accomplished by the use of the side wall backstops 194, 196 located at either end of the side wall middle portion 179. When the lid 114 is opened by sliding the lid 114 forward, the front backstop 196 eventually abuts the tray inner wall 137 and prevents the lid 114 from further forward movement and preventing the lid 114 from being fully separated from the tray 112. Likewise, when the lid is opened by sliding the lid 114 rearward, the rear backstop 194 eventually abuts the tray inner wall 137 and prevents the lid 114 from further rearward movement and preventing the lid 114 from being fully separated from the tray 112. Also, the tray ribs 142 at least partially engage the grooves 184 on either side of the lid 114 so that the lid cannot be inadvertently lifted off of the tray 112. However, due to the flexibility of the tray 112 and lid 114, the two components may be disengaged (separated) if desired.

Closing the Container 110

To close the container 110 after it has been opened by sliding the lid 114 forward, the user simply slides the lid 114 rearward until the dimples 182 in the lid 114 align with and engage the dimple stops 144 in the tray 112.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A reclosable container comprising:

a tray comprising a bottom wall, side walls, a front wall, a rear wall and an upper structure;

the bottom wall having a periphery;

the side walls, front wall and rear wall each extending upward from the periphery and terminating in an inner edge that defines an opening;

the upper structure comprising a ledge extending outward from the inner edge and terminating in an outer edge, and an inner wall extending upward from the outer edge and terminating at a rim, and a flange extending outwardly from the rim;

the upper structure further comprising two axially elongated ribs extending inwardly from the inner wall above each side wall; and a lid comprising a cover portion that covers the tray opening, two lid sidewalls extending upwardly from the cover portion and terminating in a rim, and two flanges extending laterally outward from the rim;

the lid cover portion comprising a rear cover portion, a substantially co-planar front cover portion and a recessed cover portion that is recessed below the front cover portion and the rear cover portion;

each lid side wall defining a groove configured to receive an elongated rib to secure the lid to the tray in sliding fashion; wherein the lid is moveable in a sliding fashion in a forward direction between a fully closed position in which the cover portion completely covers the opening and an open position in which the cover portion does not completely cover the opening; and wherein the lid is moveable in a sliding fashion in an opposite rearward direction between the fully closed position in which the cover portion completely covers the opening and a second open position in which the cover portion does not completely cover the opening.

2. The reclosable container of claim 1 wherein:

the tray ribs engage the lid grooves in both the fully closed and fully opened positions.

3. The reclosable container of claim 2 wherein:

as the lid moves with respect to the tray, the lid flanges slide across and remain in contact with the tray flange.

4. The reclosable container of claim 3 wherein:

the tray further comprises a partition extending laterally between the two sidewalls to divide the tray into a forward compartment and a rear compartment; and wherein moving the lid in the forward direction exposes the rear compartment and moving the lid in the rearward direction exposes the forward compartment.

5. The reclosable container of claim 1 wherein:

the tray further comprises a dimple stop disposed on each ledge; and the lid further comprises a dimple formed in the cover portion, each dimple being configured to receive a corresponding dimple stop on the tray to lock the lid in the closed position.

6. The reclosable container of claim 1 wherein:

the lid comprises two axially elongated front guides extending downward between the front cover portion and the flange;

the tray upper structure defines front guide openings located above the front wall; and the front guides slide within the front guide openings when the lid is moved in a forward direction.

7. The reclosable container of claim 6 wherein:

each lid sidewall comprises a laterally recessed middle portion located between a front portion and a rear portion; and the middle portion is connected to the rear sidewall portion by a rear backstop and to the front sidewall portion by a front backstop; wherein the movement of the lid in the forward direction is limited by the meeting of the front backstops on the lid with the tray inner wall; and the movement of the lid in the rearward direction is limited by the meeting of the rear backstops on the lid with the tray inner wall.

8. The reclosable container of claim 6 wherein:

the lid comprises two axially elongated rear guides extending downward between the rear cover portion and the flange;

the tray upper structure defines rear guide openings located above the rear wall; and the rear guides slide within the rear guide openings when the lid is moved in a rearward direction.

9. A reclosable container comprising:

a tray comprising a bottom wall, side walls, a front wall, a rear wall and an upper structure; the bottom wall having a periphery; the side walls, front wall and rear wall each extending upward from the periphery and terminating in an inner edge that defines an opening; the upper structure comprising a ledge extending outward from the inner edge and terminating in an outer edge, and an inner wall extending upward from the outer edge and terminating at a rim, and a flange extending outwardly from the rim; the upper structure further comprising two axially elongated ribs extending inwardly from the inner wall above each side wall; and a lid comprising a cover portion that covers the tray opening, two lid sidewalls extending upwardly from the cover portion and terminating in a rim, and two flanges extending laterally outward from the rim; the lid cover portion comprising a rear cover portion, a substantially co-planar front cover portion and a recessed cover portion that is recessed below the front cover portion and the rear cover portion; each lid side wall defining a groove configured to receive an elongated rib to secure the lid to the tray in sliding fashion; wherein the lid is moveable in a sliding fashion in a forward direction between a fully closed position in which the cover portion completely covers the opening and an open position in which the cover portion does not completely cover the opening.

* * * * *